US005639230A

United States Patent [19]

Lechner et al.

[11] Patent Number: 5,639,230

[45] Date of Patent: Jun. 17, 1997

[54] GEAR PUMP OR MOTOR HAVING COMPENSATION FOR VOLUME FLOW FLUCTUATIONS

[76] Inventors: Gisbert Lechner, Meisenweg 15, D-7030 Böblingen; Karl-Heinz Hirschmann, Kullenbergstrasse 43, D-7000 Stuttgart 10, both of Germany

[21] Appl. No.: 989,015

[22] PCT Filed: Jul. 5, 1991

[86] PCT No.: PCT/EP91/01262

§ 371 Date: Feb. 21, 1995

§ 102(e) Date: Feb. 21, 1995

[87] PCT Pub. No.: WO92/01870

PCT Pub. Date: Feb. 6, 1992

[30] Foreign Application Priority Data

Jul. 14, 1990 [DE] Germany ..... 40 22 500.3

[51] Int. Cl.[6] ..... F04C 2/20

[52] U.S. Cl. ..... 418/150; 418/191

[58] Field of Search ..... 418/150, 206.5, 418/191

[56] References Cited

U.S. PATENT DOCUMENTS 5,368,455 11/1994 Eisenmann ..... 418/150

FOREIGN PATENT DOCUMENTS 2439358 2/1976 Germany .
3417832 11/1985 Germany .
387966 2/1933 United Kingdom ..... 418/150

*Primary Examiner*—John J. Vrablik
*Attorney, Agent, or Firm*—Jones, Tullar & Cooper, P.C.

[57] ABSTRACT

A gear pump or motor, has two rotatively guided toothed or gear wheels in a housing, the teeth of which are mutually engaged and separate a compression chamber from a suction or discharge chamber. Depending on the rotation angle $\phi 1$ of a torque-transmitting gear wheel, an instantaneous hydraulic medium volume flow V is displaced and the mutually engaging gears wheels have a gear ratio $i=\phi 1/\phi 2$, where $\phi 2$ is the rotation angle of the non-torque transmitting gear wheel. In order to avoid pressure fluctuations and the resulting sound projection, the instantaneous gear ratio i over the whole angle of rotation $\phi 1$ of the torque-transmitting gear wheel is selected in such a way that the non-torque-transmitting gear wheel is driven at a constantly changing, periodically returning angular speed by tooth pitch, thus totally or partially compensating by an output increase or reduction the volume flow pulsation caused by the constant change in the position of the sealing limit at the teeth contact point.

6 Claims, 3 Drawing Sheets b = 26,6 mm
$r_{a1}$ = 18,7 mm
$r_{a2}$ = 18,7 mm
$a_w$ = 31,4 mm
Tooth number ratio of the toothed wheels 1,2 = 1:1

GEAR PUMP OR MOTOR HAVING COMPENSATION FOR VOLUME FLOW FLUCTUATIONS

BACKGROUND OF THE INVENTION

The invention relates to a gear, pump or motor, hereinafter gear pump, with two toothed or gear wheels rotatably mounted in a housing, the gear-tooth systems of which are in engagement with each other and separate a pressure chamber and a suction chamber or outflow chamber wherein, as a function of the angle of rotation $\phi 1$ of a torque-transmitting or drive gear wheel, an instantaneous volume flow $\dot{V}$ of a hydraulic medium is displaced and the meshing gear wheels have a gear ratio $i \mp \phi 1/\phi 2$, where $\phi 2$ is the angle of rotation of the non-torque transmitting, or driven, gear wheel.

Known gear pumps are constructed with at least one pair of gear wheels, consisting of two wheels with external teeth or gear wheels with external and internal teeth. A wheel with external teeth is driven and transmits the rotation to the second wheel with external and internal teeth. A difference is made between the leading and trailing edges of the gear wheels, depending on the direction of rotation. The leading edges transmit the rotation in the direction of rotation between the torque-transmitting gear wheel and the non-torque-transmitting or driven gear wheel. With a gear pump, the medium to be conveyed is conveyed in the tooth spaces from the suction chamber to the pressure chamber. The tooth edges which touch when operating, prevent backflow of the medium from the pressure chamber into the suction chamber. Because the position of the point of engagement, i.e. the points where the two tooth edges touch in the course of an engagement of the teeth, continuously changes in relation to the fixed housing, changes in the volume flow and as a result fluctuations in pressure occur in the pressure chamber in the same rhythm as the frequencies of the tooth engagements. The amplitudes of the pressure changes can attain nearly 20% of the maximum pressure in the pressure chamber. These volume or pressure fluctuations can cause trouble in the connected apparatus and result in high noise levels and thus in noise pollution of the surroundings.

In the known gear pumps, the pair of wheels of the gear-tooth system are designed such that there is a constant gear ratio between the driving and the driven toothed wheels. In this case pressure fluctuations in gear-tooth systems with play can only be reduced by keeping the distance between the instantaneous point of engagement and the pitch point as constant as possible. However, very narrow limitations are placed on this step by reason of gear-tooth system technology.

If the gear-tooth system is embodied to be free of play, it is possible in accordance with DE 34 17 832 A1 to attain an additional reduction of the pressure fluctuations also by an appropriate design of the trailing edges of the gear-tooth system, because then the point of engagement as the sealing threshold between the pressure chamber and the suction chamber is located not only at the leading edges, but at times also at the trailing edges of the two wheels. In a pump free of play with the conventional involute profile of the leading and trailing edges there is necessarily a reduction of the volume or pressure pulsation to one fourth, because the length of the engagement path which determines the pressure pulsation has been halved. An additional, but considerably smaller reduction of the length of the engagement path and thus of the volume or pressure pulsations, can be achieved by appropriately designed trailing edges. The leading edges continue to determine the kinematics of the pump. The leading edge profile is embodied as in the known gear pumps in which the trailing edge profile is symmetrical with the leading edge profile and without effect on the volume or pressure pulsation. With the proposed gear-tooth system free of play, the leading edge profile and the trailing edge profile of the torque-transmitting and the non-torque-transmitting wheels are the same. The gear-tooth system profiles are called simply symmetrical. Because the leading edge profile corresponds to the customary gear-tooth system profiles, no changes occur in the kinematics of the proposed gear pump with respect to those known, i.e. both toothed pump wheels have a constant angular velocity. The volume or pressure pulsation can only be reduced, but not prevented, by freedom of play and trailing edge design, because the length of the engagement path cannot be zero. Pumps free of play will not be realized in practice because thermal and elastic deformation as well as tolerances as a result of manufacturing alway require sufficient edge play.

In DE 24 39 358 A1 it is proposed to connect a gear, which compensates for the uneveness of the conveyed flow, upstream or downstream of hydrostatic pumps or motors having a displacement device which generates or receives a periodic conveyed flow. The proposed gear is intended to generate an uneven angular speed at the torque-transmitting shaft of the pump and in this way cancel the pulsation of the conveyed flow. The downstream gear is intended to generate an even angular speed on the driven gear shaft of the motor. It is furthermore proposed to embody the gear as a toothed-wheel gear. The proposed solution uses unmodified known displacement machines, i.e. the constant gear ratio usual with the gear pump and thus its kinematics are retained. The proposed solution cannot be employed in practice because of the occurring inertia forces, the loads and noise appearing because of that and for reasons of economy.

SUMMARY OF THE INVENTION

To avoid the mentioned disadvantages, it is the object of the present invention to embody a gear-tooth system of a gear pump in such a way that no pressure fluctuations appear, i.e. that the instantaneous volume flow $\dot{V}$ is constant over the angle of rotation $\phi 1$ associated with the torque-transmitting toothed wheel with constant angular speed.

To attain this object, the present invention provides that the instantaneous gear ratio i is selected over the entire range of the angle of rotation $\phi 1$ of the torque-transmitting gear wheel so that the non-torque-transmitting gear wheel is operated with a constantly changing angular speed, which is periodically repeated per tooth pitch, in such a way that the volume flow fluctuations occurring as a result of the changing sealing threshold at the tooth engagement point are compensated by either an increased or decreased fluid conveyance by the non-torque-transmitting gear wheel. To achieve the rpm which periodically fluctuate per tooth pitch, the kinematics of the pump must be changed, the leading edge profile of the torque-transmitting gear wheel and the non-torque-transmitting gear wheels must be appropriately designed. Since the pump is operated with play, the trailing edge profiles have no effect on the volume flow. The inertia forces occurring are small because of the small inertia moment of the non-torque-transmitting wheel which is the only wheel being accelerated and decelerated. Fluid pressure forces and fluid damping prevent clattering of the pump gear wheels. It is necessary to determine the required instantaneous gear ratio for designing the leading edges of both gear wheels as a function of the position of the sealing threshold, i.e. the distance of the instantaneous engagement point from the pitch point.

Considerable improvement in quiet running and a reduction of the noise level can be achieved in that the instantaneous gear ratio over the entire angle of rotation $\phi 1$ of the torque-transmitting toothed wheel is selected to be such that the instantaneous volume flow $\dot{V}$ is as constant as possible when $d\phi t/dt$ is constant, i.e. that the instantaneous gear ratio i is selected by the design of the gear-tooth system over the entire angle of rotation $\phi 1$ of the torque-transmitting gear wheel in such a way that the non-torque-transmitting gear wheel is operated with a constantly changing angular speed which is periodically repeated per tooth pitch in such a way that by increased or decreased conveyance it compensates for the constantly changing position of the sealing threshold between the pressure chamber and the suction chamber or outflow chamber caused by the volume flow pulsation.

The gear-tooth system design must be such that the mean value of the gear ratio i over a tooth engagement corresponds to the tooth number ratio of the two gear wheels, wherein the profile overlap>1 and no gear ratio jumps take place during the change to the next tooth engagement.

DETAILED DESCRIPTION

Figure 1:
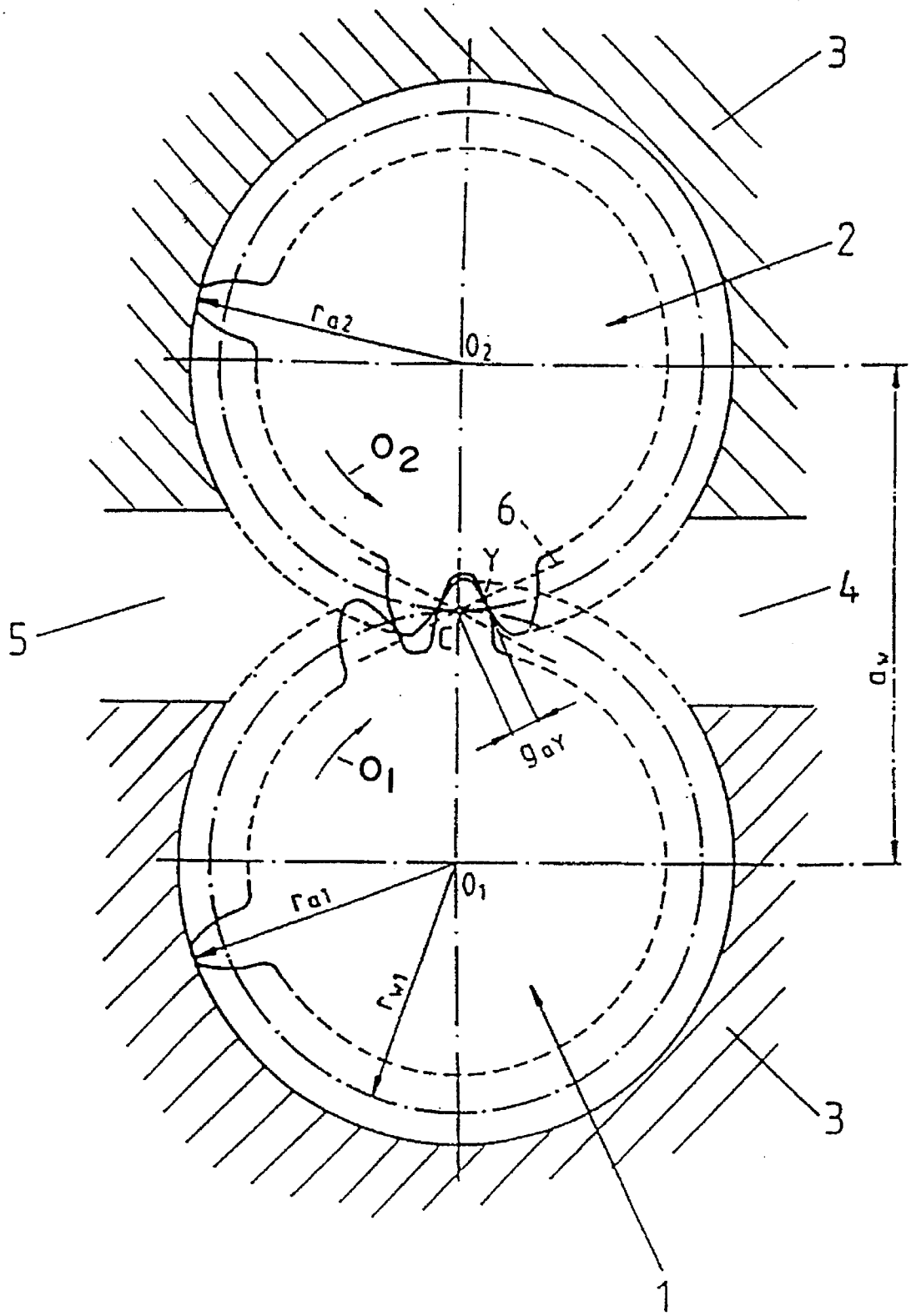
FIG. 1 is a schematic view of the two wheels of a gear pump according to the present invention.

The gear pump shown in FIG. 1 has two gear wheels 1 and 2 rotatably mounted in a housing 3. The two wheels are mutually engaged and separate a compression chamber 5 from a suction chamber 4.

Depending on the rotation angle $\phi 1$ of the torque-transmitting wheel 1, an instantaneous hydraulic medium volume flow $\dot{V}$ is displaced and the mutually toothed wheels 1 and 2 have a gear ratio (multiplication ratio) $i=\phi 1/\phi 2$. In order to avoid pressure fluctuations and the resulting sound projection, the instantaneous ratio i over the whole angle of rotation $\phi 1$ of the wheel 1 is selected in such a way that the wheel 2 is driven at a constantly changing, periodically returning angular speed by tooth pitch, thus totally or partially compensating by an output increase or reduction, the volume flow pulsation caused by the constant change in the position of the sealing limit at the teeth contact point.

The mathematical equation for the instantaneous volume flow $\dot{V}=dV/d\,\phi 1$ of a gear pump or a gear motor is:

$$\dot{V}=\frac{b}{2}\left[\left(r_{a1}^2+\frac{1}{i}\,r_{a2}^2\right)-(1+i)\,r_{w1}^2-\left(1+\frac{1}{i}\right)g_{aY}^2\right]$$

where with reference to FIG. 1: $r_{a1}$ and $r_{a2}$ are the tip circle radii of the torque-transmitting and non-torque-transmitting toothed wheels; b the tooth width of the gear wheels 1, 2; $i=\phi 1/\phi 2$ is the gear ratio between the torque-transmitting gear wheel 1 and the toothed wheel 2 meshing with it; $r_{w1}$ is the operational pitch circle radius of the torque-transmitting gear wheel 1; and $g_{ay}$ the distance of the instantaneous engagement point Y from the pitch point C, which is the point where the pitch circles contact each other.

The distance of the instantaneous engagement point Y from the pitch point C depends on the selected leading edge profile and thus indirectly on the angular position $\phi 1$ of the driving wheel.

If, in the above equation, the operational pitch circle radius $r_{w1}$ is replaced by the operational shaft distance $a_w$ between the gear wheels, for the instantaneous volume flow $\dot{V}$, using $i=r_{w2}/r_{w1}$, the instantaneous volume flow $\dot{V}$ becomes:

$$\dot{V}=\frac{b}{2}\left[\left(r_{a1}^2+\frac{1}{i}\,r_{a2}^2\right)-\frac{1}{1+i}\,a_w^2-\left(1+\frac{1}{i}\right)g_{aY}^2\right]$$

In this equation, tooth width b, the tip circle radii $r_{a1}$ and $r_{a2}$ and the operational shaft distance $a_w$ are fixed geometric values. The distance $g_{ay}$ of the instantaneous engagement point from the pitch point C fluctuates between two extreme values in rhythm with the tooth engagement frequency. The volume flow fluctuation is therefore repeated periodically with the tooth engagement frequency. To compensate for the volume flow fluctuation, the gear-tooth system of the two gear wheels 1, 2 is designed in accordance with the present invention in such a way that the only remaining variable value, namely the gear ratio i, is fixed during a tooth engagement as a function of the distance $g_{ay}$, so that the resulting volume flow fluctuation becomes zero. The instantaneous gear ratio i required for this can be determined by means of the above equation as a function of the distance $g_{ay}$ by inserting a constant value for the instantaneous volume flow $\dot{V}$ and transforming accordingly.

$$i_{1/2}^2=\frac{-B\pm\sqrt{B2-4AC}}{2A}\rightarrow i=f(g_{ay})$$

$$A=(r_{a1}^2-g_{ay}^2-Vm/\pi b)$$

$$B=r_{a1}^2+r_{a2}^2-a_w^2-2g_{ay}^2-Vm/\pi b)$$

$$C=(r_{a2}^2-g_{ay}^2)$$

$Vm$ = average volume flow

The leading edges of the pump wheel pair are selected in such a way that this interrelationship is met for all engagement positions. It is essential that the values $g_{ay}$ and i are determined simultaneously with the definition of the leading edge profile, i.e. not independently, and that the associated instantaneous position of the pitch point C is defined by the variable gear ratio i. The gear ratio progression is thus defined over a pitch. The gear ratio progression is repeated periodically per tooth pitch.

Figure 2:
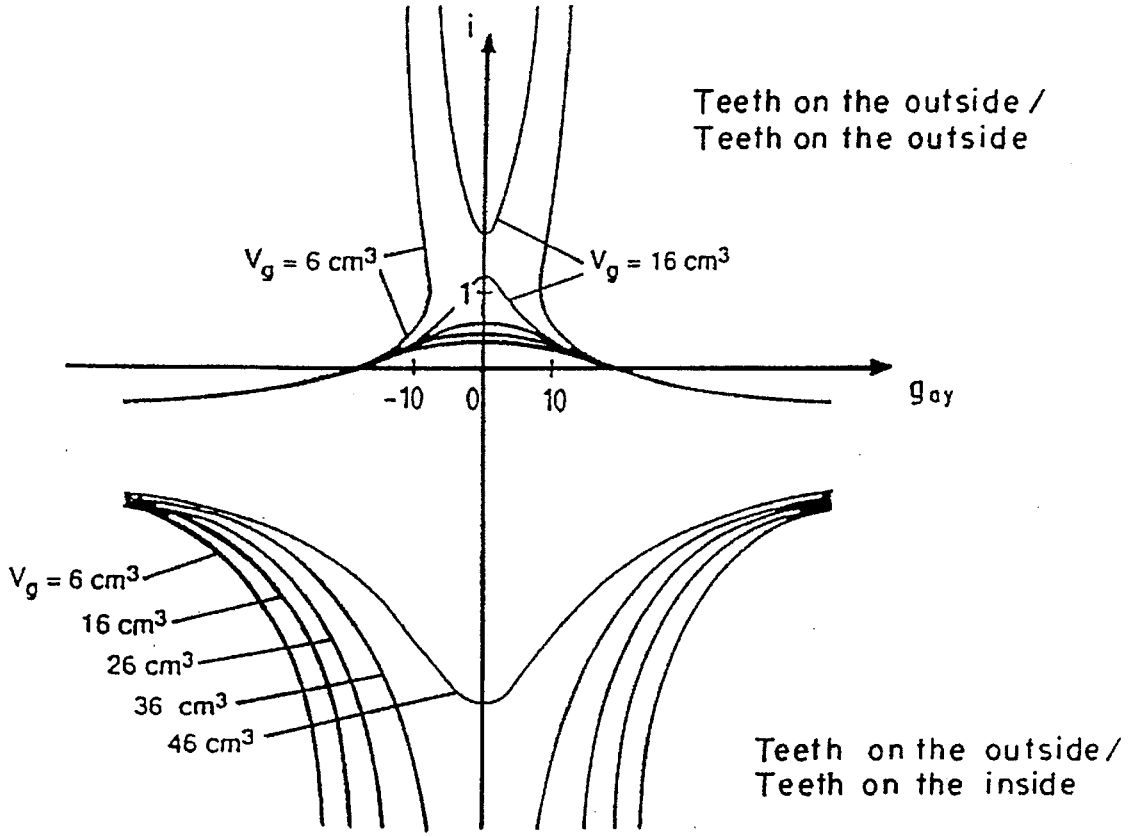
FIG. 2 is a graph showing the relationship between the instantaneous gear ratio i and the distance $g_{ay}$ with the conveying volume as a parameter.

The relationship between the instantaneous gear ratio i and the distance $g_{ay}$ with the conveying volume as a parameter is shown in FIG. 2 for a value combination of $r_{a1}$ and $r_{a2}$. Two solution ranges are the result. The curves intersecting the positive ordinate represent gear pumps with two gear wheels with external teeth, i.e., i was defined as a positive value for two gear wheels with external teeth, the curves intersecting the negative ordinate are produced by gear pumps with one gear wheel with external teeth and one with internal teeth. Only the paths of those curves having no vertical asymptodes, i.e. which steadily change from negative to positive values of $g_{ay}$ are of interest for practical realization.

In the course of the design it is furthermore required that the mean gear ratio over a tooth engagement does correspond to the tooth number ratio of the gear wheels 1, 2 in order to provide kinematic compatibility.

As a further marginal condition it is necessary that whole tooth numbers result on both wheels, and no gear ratio jumps must occur during the transition to the next tooth engagement.

Furthermore, the occurring acceleration and slowing of the non-torque-transmitting gear wheel 2 must be kept within limits. To assure continuous torque transmission, it is also necessary that the profile overlap be greater than 1. From this it necessarily follows that the instantaneous gear ratio of both teeth in engagement must be the same in both contact areas.

Figure 3:
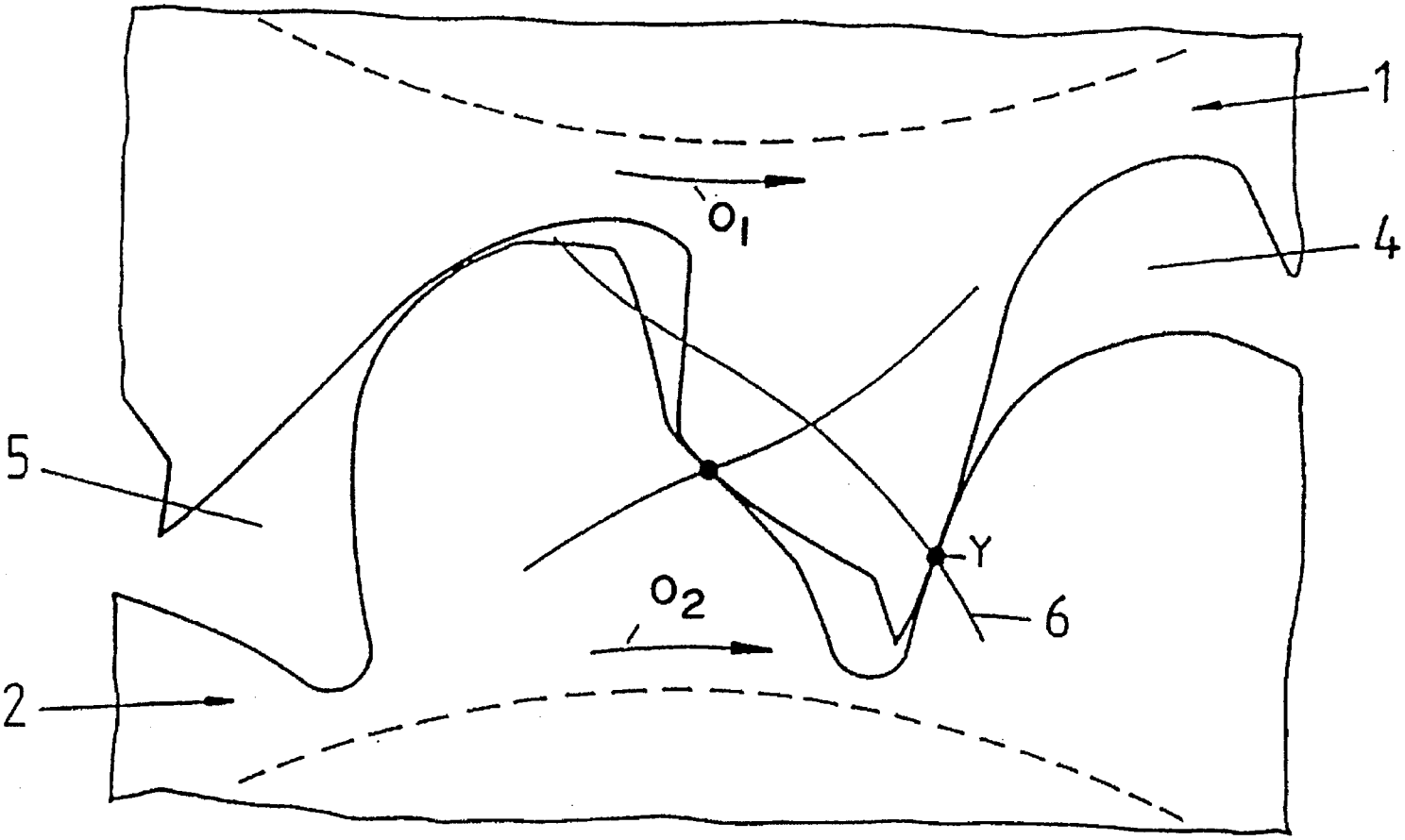
FIG. 3 is enlarged view of the meshing teeth of the gear wheels of FIG. 1 for a particularly dimensioned pair of gear wheels.

The gear-tooth system of an appropriately designed gear pump with a preferred direction of rotation and a tooth number ratio or a mean gear ratio of 1 is shown in FIG. 3. The gear-tooth system was shown as free of play, but in practice is embodied with sufficient edge play. The trailing edges of the gear wheels 1, 2 were designed in such a way that they have the same instantaneous gear ratio as the driving, i.e. sealing tooth edges, in order not to have interference in the transmission of the rotary movement in case of possible touching. Because of the play of the teeth they have no effect on the pressure pulsation. The results therefore are assymetrical edge profiles on the torque-transmitting wheel and the non-torque-transmitting wheel.

In this case the dimensions were as follows:

b=26.6 mm $r_{a1}$=18.7 mm $r_{a2}$=18.7 mm $a_w$=31.4 mm

We claim:

1. The combination of two gear wheels in a gear pump, the pump including a housing and the two gear wheels mounted for rotation in the housing, the housing and two gear wheels defining a pressure chamber and suction chamber separated from each other by the contact point of the two gear wheels, one of said two gear wheels being a driving gear wheel and the other of said two gear wheels being a driven gear wheel, wherein:

as a function of the angle of rotation $\phi 1$ of the driving gear wheel, an instantaneous volume flow V of a hydraulic medium is displaced;

the meshing two gear wheels have a gear ratio of $i=\phi 1/\phi 2$, where $\phi 2$ is the angular movement of the driven gear wheel; and i is selected to vary during rotation in dependence on the instantaneous angle $\phi 1$ of the driving gear wheel so that the driven gear wheel is operated at a continuously changing angular speed, which is periodically repeated each tooth pitch, and so that the volume flow pulsations occurring as a result of the changing of the medium separating boundary at the gear teeth contact point are compensated for by increased or decreased conveyance respectively resulting from said varying instantaneous gear ratio.

2. The combination of claim 1, wherein:

the instantaneous gear ratio is selected in accordance with the following equation:

$$\dot{V} = dV/d\phi 1 = \frac{b}{2}\left[\left(r_{a1}^2+\frac{1}{i}\,r_{a2}^2\right)-\frac{1}{1+i}\,a_w^2-\left(1+\frac{1}{i}\right)g_{ay}^2\right]=\text{constant}$$

Where:

b is the tooth width;

$r_{a1}$ and $r_{a2}$ are tip circle radii;

$a_w$ is the distance between the operational shafts; and $g_{ay}$ is the distance between the instantaneous engagement point Y from the instantaneous pitch point C.

3. The combination of claim 1, wherein:

the instantaneous volume flow is defined as follows:

$$\dot{V} = dV/d\phi 1 = \frac{b}{2}\left[\left(r_{a1}^2+\frac{1}{i}\,r_{a2}^2\right)-(1+i)r_{w1}^2-\left(1+\frac{1}{i}\right)g_{ay}^2\right]=\text{constant}$$

4. The combination of claim 1, wherein:

the mean value of the gear ratio i over the tooth engagement corresponds to the tooth number ratio of the two gear wheels;

the profile overlap is greater than one; and no gear ratio jumps occur during transition to the next tooth engagement and engagement angles result by means of which the required torque is transmitted.

5. The combination of claim 2, wherein:

the instantaneous volume flow is defined as follows:

$$\dot{V} = dV/d\phi 1 = \frac{b}{2}\left[\left(r_{a1}^2+\frac{1}{i}\,r_{a2}^2\right)-(1+i)r_{w1}^2-\left(1+\frac{1}{i}\right)g_{ay}^2\right]=\text{constant}$$

6. The combination of claim 2, wherein:

the mean value of the gear ratio i over the tooth engagement corresponds to the tooth number ratio of the two gear wheels;

the profile overlap is greater than one; and no gear ratio jumps occur during transition to the next tooth engagement and engagement angles result by means of which the required torque is transmitted.

* * * * *